US011469021B2

(12) United States Patent
Chorley et al.

(10) Patent No.: US 11,469,021 B2
(45) Date of Patent: Oct. 11, 2022

(54) SUPERCONDUCTOR CURRENT LEADS

(71) Applicant: Siemens Healthcare Limited, Camberley (GB)

(72) Inventors: Simon Chorley, Oxford (GB); Michael Simpkins, Oxford (GB)

(73) Assignee: Siemens Healthcare Limited, Camberley (GB)

( * ) Notice: Subject to any disclaimer, the term of this patent is extended or adjusted under 35 U.S.C. 154(b) by 321 days.

(21) Appl. No.: 16/825,151

(22) Filed: Mar. 20, 2020

(65) Prior Publication Data

US 2021/0183552 A1 Jun. 17, 2021

(30) Foreign Application Priority Data

Mar. 20, 2019 (GB) ..... 1903808

(51) Int. Cl.

| | |
|---|---|
| ***H01B 12/00*** | (2006.01) |
| ***H01F 6/02*** | (2006.01) |
| ***H01F 6/04*** | (2006.01) |
| ***H01F 6/06*** | (2006.01) |

(52) U.S. Cl.

CPC ..... *H01F 6/02* (2013.01); *H01B 12/00* (2013.01); *H01F 6/04* (2013.01); *H01F 6/06* (2013.01); *H01F 6/065* (2013.01)

(58) Field of Classification Search

CPC ..... H01F 6/00; H01F 6/02; H01F 6/06; H01F 6/065; H01B 12/00

See application file for complete search history.

(56) References Cited

U.S. PATENT DOCUMENTS

| | | | |
|---|---|---|---|
| 6,584,333 | B1 | 6/2003 | Gauss et al. |
| 2016/0217889 | A1 | 7/2016 | Ko et al. |
| 2019/0252104 | A1 | 8/2019 | Slade |

FOREIGN PATENT DOCUMENTS

| | | | |
|---|---|---|---|
| CN | 104835611 | A | 8/2015 |
| CN | 109273191 | A | 1/2019 |
| EP | 1895604 | A2 | 3/2008 |
| GB | 2490690 | A | 11/2012 |
| JP | H06140243 | A | 5/1994 |
| JP | 2005353777 | A | 12/2005 |
| WO | 2018078327 | A1 | 5/2018 |

OTHER PUBLICATIONS

Lee, Woo Seung et al.: "Quench Protection for HTS Current Leads by Adding Connected HTS Bridges" in IEEE Transactions On Applied Superconductivity, vol. 24, No. 3, Jun. 2014.

(Continued)

*Primary Examiner* — Ramon M Barrera
(74) *Attorney, Agent, or Firm* — Banner & Witcoff Ltd.

(57) ABSTRACT

A current lead for supplying current to a superconducting device, the current lead having a high temperature superconductor (HTS) conductor extending along a length of the current lead, the HTS conductor thermally and electrically joined to an electrical shunt. Voltage taps are connected to respective ends of the HTS conductor for connection to a quench heater in thermal contact with a superconducting device. A quench in the HTS conductor gives rise to a voltage appearing between the voltage taps, and the voltage is applied to the quench heater to give rise to quench within the superconducting device.

12 Claims, 2 Drawing Sheets

(56) References Cited

OTHER PUBLICATIONS

Marchevsky, M. et al.: "Quench detection method for 2G HTS wire" in Superconductor Science and Technology, vol. 23, No. 3, Feb. 22, 2010.

Green, M. A. et al.: "Protecting the Leads of a Powered Magnet that is protected with Diodes and Resistors" in IEEE Transactions on Applied Superconductivity, vol. 22, No. 3, p. 4702204-4702204, Jun. 2012.

Ballarino, A. et al.: "Design and Tests on the 30 to 600 A HTS Current Leads for the Large Hadron Collider" LHC Project Report 78, European Organization for Nuclear Research European Laboratory for Particle Physics, 1996.

Green, Michael A.: "The Effect of Magnetic Field on HTS Leads What Happens when the Power Fails at RAL?" LBNL-62458, Lawrence Berkeley National Laboratory, Berkeley CA 94720, USA, Feb. 14, 2007.

Bae J H et al.: "Quench Characteristics of HTS Current Lead", 4th International Youth Conference on Energy (IYCE), 2013, pp. 1-4.

SUPERCONDUCTOR CURRENT LEADS

TECHNICAL FIELD

The present disclosure relates to current leads for superconducting devices. In an example arrangement, a superconducting device such as a cylindrical magnet, is cooled to a temperature below the transition temperature of the superconducting material used. In certain conventional arrangements, the superconducting device is cooled to the temperature of boiling helium, about 4K.

BACKGROUND

It is necessary to provide current leads to enable electrical current to be introduced into, and removed from, the superconducting device. These current leads will extend from a region at ambient temperature (e.g. 300K) to a region at the temperature of the superconducting device (e.g. 4K). It is important that as little heat as possible is carried by the current leads from the region at ambient temperature to the region at the temperature of the superconducting device and that the Ohmic heating in the current lead is as low as possible. These are competing requirements. For low thermal conductance, the current leads are preferably of a material of low thermal conductivity and are of a small cross-sectional area-to-length ratio. For low Ohmic heating, the current leads are preferably of a material of high electrical conductivity (which may be proportional to thermal conductivity through the Wiedermann-Franz law) and large cross-sectional area-to-length ratio. The choice of material is complicated by the property that a given material will have different thermal and electrical conductivity at different temperatures. The thermal and electrical conductivity of a material at 4K will be significantly different from the thermal and electrical conductivity of the same material at 300K. While the requirement for low thermal conductance leads to a requirement of low material cross-sectional area or long length, the current leads must typically be capable of carrying a very large current. That tends towards a requirement of large material cross-sectional area or short length, to provide the required electrical conductance.

This conflict is conventionally partially addressed by use of a high temperature superconductor (HTS) conductor. The HTS conductor may extend between parts of the current lead which, in use, are at temperatures below a transition temperature of the HTS material. HTS conductors typically have very high electrical conductivity but relatively low thermal conductivity.

In certain conventional arrangements, the superconducting device is cooled by a two-stage cryogenic refrigerator. A first stage of the refrigerator may cool to about 50K, while a second stage of the refrigerator may cool to about 4K. An HTS conductor may be provided as part of the current lead, over a section of the current lead which extends between the first stage of the refrigerator and the second stage of the refrigerator.

FIG. 1 illustrates an example of such a conventional current lead arrangement 10, including one or more HTS conductors 11 having a higher-temperature part 12, electrically linked to an outer resistive part 22 which is thermally linked to a refrigerator first stage 14 with an electrically resistive layer 38 and a lower-temperature part 16 thermally linked to a refrigerator second stage 18 with an electrically resistive layer 38. The HTS conductor 11 may be electrically connected in parallel with an electrical shunt 20. The outer resistive section 22 which extends from the refrigerator first stage 14 away from the refrigerator second stage 18 and towards ambient temperature is electrically connected external to an outer vacuum chamber (OVC) enclosing the superconducting device 26.

Two options for enabling such electrical connection are:

- outer resistive section 22 itself passes through a bellows in the OVC wall, the bellows give the flexibility required for thermal contraction, or
- outer resistive section 22 is connected (inside the OVC) to a braid 23 which goes to a feed-through in the OVC wall, the braid gives the flexibility required for thermal contraction. The outer resistive section 22 or the feed-through, as appropriate, would then be connected outside the OVC to a power supply by a cable.

A low resistance wire 24 electrically connects the current lead arrangement 10 to the superconducting device 26 through a transition block 17. The low resistance wire 24 is typically a low-temperature superconducting wire. The low resistance wire 24 is essentially at the temperature of the superconducting device 26 over its whole length.

The two ends of the HTS conductor 11 may have bolted interface blocks 17, 37 for connecting to the low resistance wire 24 and outer resistive part 22, respectively.

Example conventional materials for the described components are:

- first stage 14 of the refrigerator: copper
- second stage 18 of the refrigerator: copper
- transition blocks 17, 37: copper
- resistive section 22: copper or brass
- electrical shunt 20: stainless steel or brass
- HTS conductor 11: $1^{st}$ generation (e.g. BSCCO) or $2^{nd}$ generation (e.g. ReBCO)
- Low resistance wire 24: copper or LTS
- Electrically resistive layer 38: Stycast® or Kapton®

High temperature superconductor (HTS) current leads such as the current lead arrangement 10 are required for modern low- and zero cryogen systems to transfer electrical current into and from the superconducting device 26 with minimal thermal dissipation.

In a failure case, such as loss of power or break-down of the associated cryogenic refrigerator, the higher-temperature part 12 of the HTS conductor 11 can warm up to above the transition temperature of the HTS. That part 12 then becomes very resistive. The magnet could be ramping at the time, either up or down as normal, or down in an emergency to avoid a thermal quench due to the failed refrigerator. The term "ramping" refers to the controlled introduction of electrical current into, or removal of electrical current from, the superconducting device 26. This typically involves a voltage arising across terminals of the superconducting device 26. The introduction of electrical current may be referred to as "ramping up" while the removal of electrical current may be referred to as "ramping down".

The superconducting device 26 typically has a high inductance, and the appearance of resistance in the circuit will not immediately reduce the amount of current flowing in the current lead 10. The higher-temperature part 12 of the HTS conductor 11 very rapidly warms until it is damaged, in so-called "burn-out".

Some conventional arrangements for reducing the susceptibility to burn-out include the following:

1. An electrical shunt of electrically conductive material 20 is electrically connected in parallel with the HTS conductor 11 to take the electrical current when the HTS conductor 11 is in a resistive state. A problem with this arrangement is that the shunt has to have a significant cross-section-to-length ratio to carry the full magnet current for long enough to ramp the magnet down to zero current and so results in high static heat-load due to the thermal conductivity of the material of the electrical shunt.

2. The temperature of the HTS conductor may be actively measured and electrical current can be removed from the superconducting device 26 in a controlled manner, known as "ramping down" if the measured temperature of the HTS conductor rises to within some specified value close to the transition temperature of the HTS conductor.
3. The voltage across the HTS conductor may be actively measured and electrical current can be removed from the superconducting device 26 in a controlled manner, known as "ramping down" if a non-zero voltage is detected.
4. The strength of a magnetic field produced by the HTS conductor 11 may be monitored, for example by using a Hall probe, and electrical current can be removed from the superconducting device 26 in a controlled manner, known as "ramping down" if quenching of the HTS conductor is detected by a change in magnetic field it produces as the current redistributes.

The problem with the first option is the static heat leak may be unacceptably high. The problem with the latter three options is that they are all active protection methods requiring sensors and control circuitry and so are vulnerable to power failure or to sensors or power supplies being unplugged or other failure modes of active systems.

A further known proposal includes the addition of multiple parallel HTS conductors cross linked with further HTS conductors. While this may assist with some quenches of an HTS conductor, such that current may be diverted from a quenched HTS conductor to flow in a parallel HTS conductor, this will not address the most common failure mode, which is a failure of the cryogenic refrigerator, which causes quench at the higher-temperature part 12 of the HTS conductor.

SUMMARY

The present disclosure accordingly provides an improved HTS current lead which addresses the above problems and provides a passively protected HTS conductor.

The present disclosure therefore provides current leads and arrangements as defined in the appended claims.

BRIEF DESCRIPTION OF THE DRAWINGS

The above, and further, objects characteristics and advantages of the present disclosure will become more apparent from the following description of certain aspects of the present disclosure, given by way of examples only, in conjunction with the accompanying drawings, wherein.

DETAILED DESCRIPTION

The present disclosure improves upon the conventional current lead arrangement described above by providing a simple and reliable passive protection method.

Figure 1:
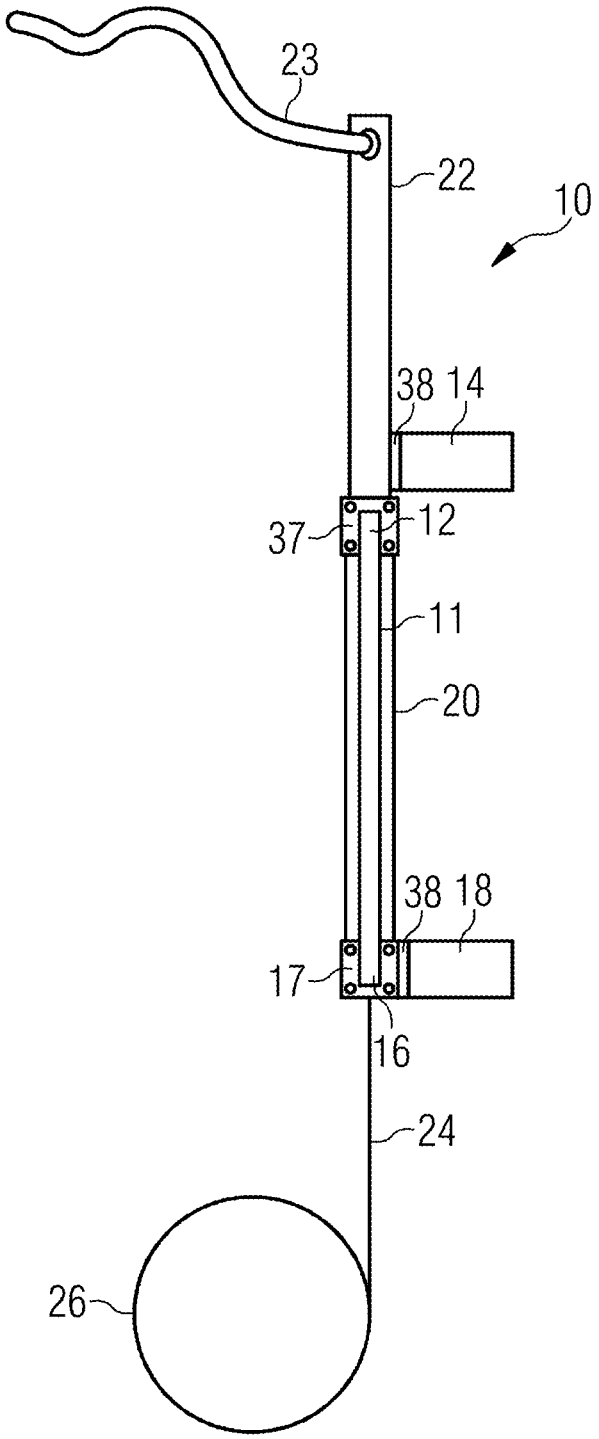
FIG. 1 schematically illustrates a conventional current lead arrangement.
Figure 2:
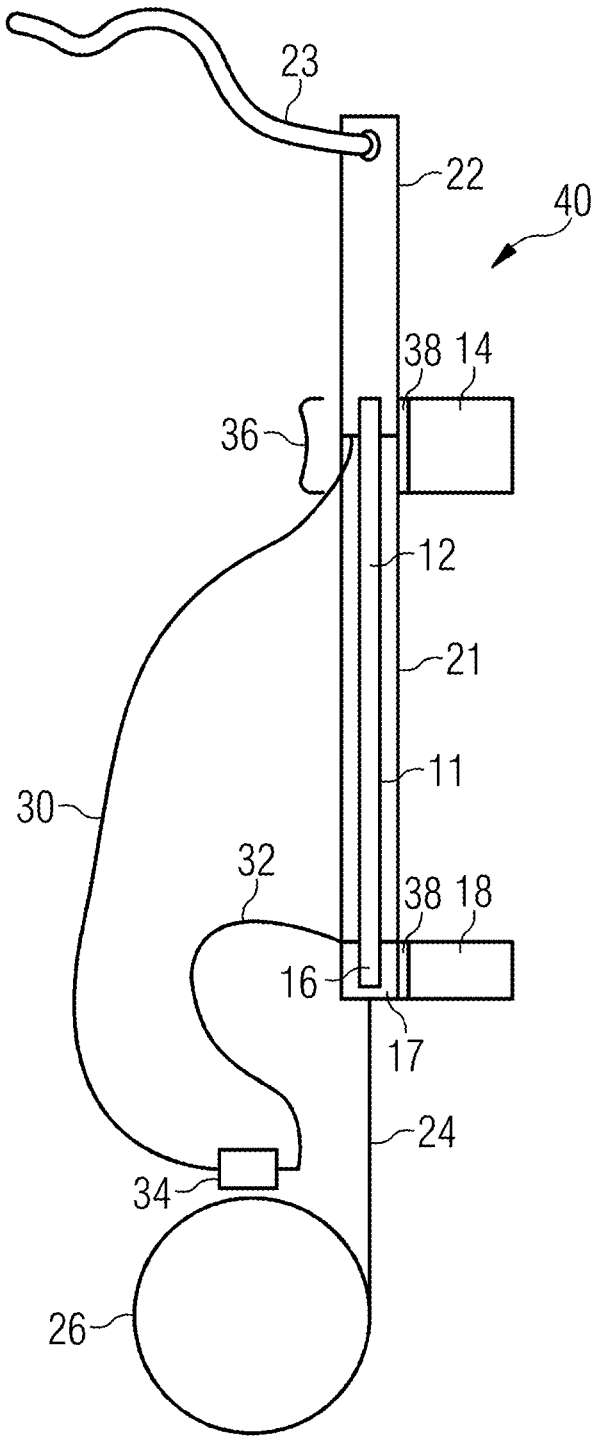
FIG. 2 schematically illustrates an example current lead arrangement of the present disclosure.

A current lead arrangement of the disclosure, such as illustrated at 40 in FIG. 2 provides passive protection of the HTS conductor. In case of a full or partial quench of the HTS conductor while carrying an electrical current, a voltage will be developed across the quenched part of the HTS conductor. This voltage will appear at voltage taps 30, 32. According to a feature of the present disclosure, this voltage is applied to a quench heater 34 which is in thermal contact with superconducting device 26. In certain aspects, multiple quench heaters 34 are provided, at least one in contact with each of a plurality of superconducting coils.

The voltage developed across the HTS conductor 11 between voltage taps 30, 32 is applied to quench heater(s) 34. This causes a current to flow in the heater(s). The resulting heating effect warms a part of the superconducting device 26 and raises its temperature above the transition temperature of the superconducting material used. This causes the superconducting device 26 to quench. As is conventional, arrangements not described herein will be provided for dealing with a quench of the superconducting device 26.

In an example aspect, the superconducting device 26 comprises a plurality of superconducting coils, and each of the superconducting coils is provided with a quench heater 34 in thermal contact therewith and connected to receive the voltage appearing between the voltage taps 30, 32.

Quench of the superconducting device 26 means that electrical current will be ramped down from the device in a controlled but rapid way, which will correspondingly reduce the current flowing through the HTS conductor 11 of the current lead of the present disclosure before it can "burn out". The current lead will accordingly be protected from damage.

In preferred aspects of the disclosure, the HTS conductor 11 is fully electrically shunted along its length by electrical shunt 21 of a material of relatively high thermal heat capacity but relatively low thermal conductivity, e.g. stainless steel. In normal operation the low thermal conductivity of the electrical shunt 21 minimises the static heat leak therethrough to around e.g. 10-60 mW for a lead designed to operate at circa 500 A.

During a quench of the HTS conductor, the electrical current being carried by the HTS conductor is diverted into the shunt 21 which carries the current for long enough to develop voltage to drive the quench circuit, but at the same time the high heat capacity of the material of the electrical shunt stops it from heating up enough to damage the material of the HTS conductor, for example in the 5 to 60 second range to reach approximately room-temperature.

The voltage produced across the HTS conductor 11 during a quench of the HTS conductor is typically small, e.g. 0.2V, meaning the voltage taps 30, 32 have to be of relatively low resistance. The voltage tap 32 near the refrigerator second stage 18 could be made of copper, for example, whilst the voltage tap 30 near the refrigerator first stage 14 could be made of brass, for example, to minimise the heat leak from the first refrigerator stage 14 to the superconductor device 26 through the voltage tap 30. Heater 34 may typically have a resistance of 5 to 10Ω and a total resistance of the voltage taps may be 0.5 to 2Ω.

In another aspect of the present disclosure, the voltage taps 30, 32 are made of an HTS material to further minimise the heat leak from the first refrigerator stage 14 to the superconductor device 26 through the voltage tap 30. Use of an HTS material for the voltage taps 30, 32 also allows the quenching lead 11 to trigger a quench in the superconducting device 26 at a lower voltage, since less voltage is lost in electrical resistance present in the voltage taps 30, 32.

In a certain such aspect, the voltage taps 30, 32 are of the same HTS material as the HTS conductor 11. However, the voltage taps 30, 32 may continue to operate even after the HTS conductor 11 quenches as the voltage leads will carry less current than the HTS conductor 11 and so the critical temperature will be higher.

In an alternative such aspect, the voltage taps 30, 32 are of an HTS material different from the HTS material of the HTS conductor 11. The HTS material of the voltage taps may be selected to have a higher superconducting transition temperature $T_c$ than the HTS material of the HTS conductor 11 so that the voltage taps continue to work during a thermally induced quench of the HTS conductor 11.

Preferably, the HTS conductor 11 is well attached, thermally and electrically along its length to the electrical shunt 21, for example by soldering with an indium-based solder or other low temperature solder. By having the HTS conductor thermally connected along its length to the electrical shunt, any local hotspots caused by quench in a part of the HTS conductor will be cooled by thermal conduction away from the HTS conductor into the material of the electrical shunt 21. The hotspot temperature may accordingly be reduced by heat loss from the HTS conductor 11 into the electrical shunt 21. The electrical shunt may also promote quench propagation along the length of the HTS conductor 11 by thermal conduction from the hotspot along the length of the electrical shunt 21. Such action contributes to developing a significant voltage between voltage taps 30, 32 to operate the heater 34 without locally over-heating the HTS conductor.

Preferably, a section 36, for example a few centimetres long, of the HTS conductor near the refrigerator first stage 14 is thermally anchored to the refrigerator first stage 14 with a thin insulating layer 38 to improve cooling. Preferably, this is arranged such that the section 36 is isothermal along its length with the refrigerator first stage 14. When the HTS conductor starts to quench, for example due to a refrigeration failure, the isothermal section 36 quenches and becomes resistive in one go, giving rise to a significant voltage rise that can be used to quench the superconducting device 26 by the quench heater 34. As the isothermal section 36 is thermally anchored to something with large heat capacity, that is to say the refrigerator first stage 14, it should not be damaged in the time taken to quench the superconducting device 26 by way of the heater 34, as the rate of temperature rise will be low.

In a preferred aspect of the disclosure, and as illustrated in FIG. 2, a current lead 40 of the present disclosure may comprise first 22, second 21 and third 17/24 stages that are welded or brazed together, or otherwise attached in an electrically-conductive and thermally-conductive manner with the HTS conductor 11 overlapping each stage such that the thermal and electrical joints are reliable and the current is passed from one to the other with minimal resistance. In the illustrated aspect, the first stage is the outer resistive section 22; the second stage is the electrical shunt 21; and the third stage is the transition block 17 and low resistance wire 24.

Stainless steel may be found to be a suitable material for the electrical shunt 21. However, attention should be paid that the electrical shunt 21 should be made from a material which has a similar coefficient of thermal expansion as the material of the HTS conductor 11, so that thermal stress between the HTS conductor 11 and the electrical shunt 21 is minimised both during cooling of the superconducting device 26 to operating temperature and during rapid warming such as may be caused by quench of the HTS conductor 11.

The present disclosure accordingly provides a current lead 40 which comprises an HTS conductor 11 which is protected against damage caused by quench in the material of the HTS conductor 11.

Quenches in HTS materials are known to occur quickly, but to propagate slowly. This entails a risk of damage to HTS material during quench, by burn-out due to an electrical current passing through the material at the time of the quench. Conventionally, active quench protection was provided in order to ensure rapid protection of HTS current leads used for providing electrical current to a superconducting device. The present disclosure, however, provides passive protection to be applied to an HTS conductor 11 when used in a current lead for a superconducting device.

The present disclosure most particularly addresses the most common cause of HTS current lead quenches, which is warming of the first refrigerator stage 14 due to refrigerator failure. According to an aspect of the present disclosure, the HTS conductor 11 is well thermally and electrically connected to an electrical shunt 21 of relatively high thermal heat capacity but relatively low thermal conductivity, e.g. stainless steel. Should quench arise within the material of the HTS conductor, heat generated in a resistive part of the HTS conductor 11 is conducted into the electrical shunt 21 which limits the temperature of the quenched part of the HTS conductor and enables the quench to propagate along the length of the electrical shunt, and so along the length of the HTS conductor 11, without damage to the HTS conductor. Propagation of the quench along the HTS conductor allows sufficient voltage to be developed across the HTS conductor to operate a quench heater 34, thereby introducing quench into superconducting device 26. Passive protection of the HTS conductor is thereby assured.

In preferred aspects, a section 36 of the HTS conductor is isothermal with a high heat capacity mass, for example by connecting to a copper block at the refrigerator first stage 14. Such an isothermal section 36 ensures that an initial quench in the HTS conductor 11 immediately extends over the length of the isothermal section, so that a very small quenched region is not initially formed, which risks burn-out to the very small region. The initial quench will extend over the length of the isothermal section 36 and so will generate an appreciable voltage from the beginning of the quench. Since the initial quench extends over the isothermal section, the HTS conductor will not heat up enough to be locally damaged.

The present disclosure accordingly provides passive quench protection of HTS conductor 11 in HTS current lead, which is simpler, cheaper and more reliable then active protection arrangements conventionally employed.

The invention claimed is:

1. A current lead for supplying current to a superconducting device, the current lead having a high temperature superconductor (HTS) conductor extending along a length of the current lead, the HTS conductor being thermally and electrically joined to an electrical shunt, wherein voltage taps are connected to respective ends of the HTS conductor for connection to a quench heater in thermal contact with the superconducting device, whereby a quench in the HTS conductor causes a voltage between the voltage taps, and the voltage is applied to the quench heater to give rise to quench within the superconducting device.

2. A current lead according to claim 1 wherein the electrical shunt comprises stainless steel.

3. A current lead according to claim 1, wherein a section of the HTS conductor is isothermal with a high heat capacity mass.

4. A current lead according to claim 1, wherein the electrical shunt is connected along the full length of the HTS conductor.

5. A current lead according to claim 4, wherein the HTS conductor is soldered along its length to the electrical shunt by an indium-based solder.

6. A current lead according to claim 1, wherein a first of the voltage taps comprises copper and a second of the voltage taps comprises brass, and wherein, in use, the first voltage tap is at a lower temperature than the second voltage tap.

7. A current lead according to claim 1, wherein the voltage taps comprise an HTS material.

8. A current lead according to claim 7, wherein the voltage taps comprise an HTS material which has a higher superconducting transition temperature $T_c$ than the HTS material of the HTS conductor.

9. An arrangement, comprising:

a superconducting device configured to be cooled by a two-stage cryogenic refrigerator having a first stage and a second stage, wherein in operation the second stage is cooled to a cooler temperature than the first stage; and a current lead according to claim 1, wherein the current lead comprises first, second, and third stages attached in an electrically-conductive and thermally-conductive manner with the HTS conductor overlapping each stage, wherein the first stage of the current lead is cooled by the first stage of the cryogenic refrigerator, the second stage is the electrical shunt, and the third stage is cooled by the second stage of the cryogenic refrigerator.

10. An arrangement according to claim 9, wherein a section of the HTS conductor is thermally linked to the refrigerator first stage with an insulating layer.

11. An arrangement according to claim 9, wherein a section of the HTS conductor is thermally linked to a transition block with an insulating layer.

12. An arrangement according to claim 9, wherein the superconducting device comprises a plurality of superconducting coils, and each of the superconducting coils is provided with a quench heater in thermal contact therewith and connected to receive the voltage appearing between the voltage taps.

* * * * *